US006302208B1

(12) United States Patent
Walker et al.

(10) Patent No.: US 6,302,208 B1
(45) Date of Patent: Oct. 16, 2001

(54) GRAVEL PACK ISOLATION SYSTEM

(76) Inventors: David Joseph Walker, 101 Oak Brook Blvd., Lafayette, LA (US) 70508; William Mark Richards, 4911 Bayboro Park Dr., Friendswood, TX (US) 77546

( * ) Notice: Subject to any disclaimer, the term of this patent is extended or adjusted under 35 U.S.C. 154(b) by 0 days.

(21) Appl. No.: 09/312,102

(22) Filed: May 14, 1999

Related U.S. Application Data

(60) Provisional application No. 60/085,620, filed on May 15, 1998.

(51) Int. Cl.[7] ..... E21B 43/04

(52) U.S. Cl. ..... 166/278; 166/51; 166/334.4

(58) Field of Search ..... 166/278, 51, 373, 166/386, 334.4

(56) References Cited

U.S. PATENT DOCUMENTS

| | | | | |
|---|---|---|---|---|
| 5,343,949 | * | 9/1994 | Ross et al. | 166/278 |
| 5,865,251 | * | 2/1999 | Rebardi et al. | 166/278 |
| 5,931,229 | * | 8/1999 | Lehr et al. | 166/278 |
| 5,975,205 | * | 11/1999 | Carisella | 166/278 |
| 5,988,285 | * | 11/1999 | Tucker et al. | 166/373 |

* cited by examiner

*Primary Examiner*—William Neuder
(74) *Attorney, Agent, or Firm*—Baker Botts L.L.P.

(57) ABSTRACT

An isolation system having: an isolation string, wherein the isolation string has a packing assembly which secures the isolation string in a wellbore casing, wherein the isolation string has a production screen which allows production fluid to pass into the isolation string; an isolation sleeve which slides within the isolation string between open and closed positions, wherein the open position allows fluid communication between the production screen and an interior portion of the isolation string and the closed position prevents fluid communication between the production screen and an interior portion of the isolation string, wherein the isolation sleeve comprises at least one isolation valve which is coupled within the isolation sleeve, wherein the at least one isolation valve is movable between open and closed positions; a locking device which locks and unlocks the isolation sleeve in an open position, wherein the locking device comprises a trigger that secures the isolation sleeve to the isolation string before the trigger is activated and releases the isolation sleeve from the isolation string after the trigger is activated, wherein the trigger comprises: a piston collar having a solid cylindrical portion attached to the isolation sleeve and a finger portion having at least one finger, wherein the at least one finger has a head at a distal end; and at least one recess in the isolation string, wherein the head of the at least one finger is engaged in the at least one recess; a cylindrically shaped pop lock positioned adjacent the head of the at least one finger so that the head is between the pop lock and the recess, wherein the pop lock secures the head relative to the recess; and a latch attached to the service tool which couples with the pop lock, wherein the trigger is activated by removing the pop lock from the position adjacent the head; and an activation tool which allows the isolation sleeve to move to a closed position, wherein the activation tool is a piston driven by a hydrostatic chamber which comprises lower pressure within the hydrostatic chamber than without, and wherein the piston moves the isolation sleeve from the open to the closed position.

19 Claims, 16 Drawing Sheets

GRAVEL PACK ISOLATION SYSTEM

CONTINUATION STATEMENT

This application claims priority to U.S. Provisional Application No. 60/085,620, filed May 15, 1998.

BACKGROUND OF THE INVENTION

1. Field of the Invention

The present invention relates to the field of isolation systems and gravel pack assemblies for use in a wellbore. More particularly, the invention provides an improved system and method for zone isolation following gravel pack completions installed in a wellbore.

2. Description of the Prior Art

Typical prior art isolation systems involve intricate positioning of tools which are installed down-hole after the gravel pack. An example of this type of system is available from Baker. This system utilizes an anchor assembly which is run into the well bore after the gravel pack. The anchor assembly is released by a shearing action, and subsequently latched into position.

Certain disadvantages have been identified with these systems. For example, prior conventional isolation systems have had to be installed after the gravel pack, thus requiring greater time and extra trips to install the isolation assemblies. Also, prior systems have involved the use of fluid loss control pills after gravel pack installation, and have required the use of thru-tubing perforation or mechanical opening of a wireline sliding sleeve to access alternate or primary producing zones. Since multiple trips into the well are required for gravel pack and isolation, these systems are time consuming methods and provide less flexibility and reliability.

An example of an isolation washpipe for well completions is disclosed in U.S. Pat. No. 5,343,949, incorporated herein by reference. In this system, there is an expansion joint which is used to push a closing sleeve into a closed position over the production screen.

More recently, isolation systems have been developed which do not require the running of tailpipe and isolation tubing separately. Instead, the system uses the same pipe to serve both functions: as tailpipe for circulating-style treatments and as production/isolation tubing. An example of this type of isolation system is disclosed in U.S. Pat. No. 5,865,251, incorporated herein by reference. An isolation sleeve is installed inside the production screen at surface and placed in the wellbore simultaneously with the service tool. The isolation sleeve is thereafter controlled in the wellbore by means of the inner service string. This system is adapted for well control purposes and for well bore fluid loss control. It combines simplicity, reliability, safety and economy, while also affording flexibility in use.

However, '251 provides only small orifices for circulation of the gravel pack fluid through the isolation sleeve. Further, '251 allows debris to become trapped between the production screen and the isolation sleeve. Further, because the washpipe extends through the isolation sleeve during the gravel pack operation, there is the possibility that debris will become lodged between the isolation sleeve and the wash pipe. This debris could cause the washpipe to hang or jam upon withdrawal so that the entire service string is permanently lodged in the isolation sleeve. Therefore, there is a need for a system which allows the isolation sleeve to be closed without a washpipe extending through the isolation sleeve. Further, there is a need for an isolation sleeve which does not allow debris to become accumulated between the isolation sleeve and the production screen and which allows fluid to freely pass through the isolation sleeve during the gravel pack operation.

SUMMARY OF THE INVENTION

The present invention is a system and method for providing full fluid flow through the production screen during a gravel pack operation and which does not allow debris to accumulated between the isolation system and the production screen. Further, the isolation system is closeable immediately upon completion of the gravel pack operation by the service tool which performed the gravel pack. Closure of the isolation system may even be accomplished without a wash pipe extending through the isolation system. The system comprises an activation tool which allows the isolation system to operate between the open and closed positions.

According to one aspect of the invention, there is provided an isolation system having: an isolation string, wherein the isolation string has a packing assembly which secures the isolation string in a wellbore casino, wherein the isolation string has a production screen which allows production fluid to pass into the isolation string; an isolation sleeve which slides within the isolation string between open and closed positions; a locking device which locks and unlocks the isolation sleeve in an open position; and an activation tool which allows the isolation sleeve to move to a closed position, wherein the open position allows fluid communication between the production screen and an interior portion of the isolation string and the closed position prevents fluid communication between the production screen and an interior portion of the isolation string.

According to a further aspect of the invention, there is provided an isolation system having: an isolation string, wherein the isolation string has a packing assembly which secures the isolation string in a wellbore casing, wherein the isolation string has a production screen which allows production fluid to pass into the isolation string; an isolation sleeve which slides within the isolation string between open and closed positions, wherein the open position allows fluid communication between the production screen and an interior portion of the isolation string and the closed position prevents fluid communication between the production screen and an interior portion of the isolation string, wherein the isolation sleeve comprises at least one isolation valve which is coupled within the isolation sleeve, wherein the at least one isolation valve is movable between open and closed positions; a locking device which locks and unlocks the isolation sleeve in an open position, wherein the locking device comprises a trigger that secures the isolation sleeve to the isolation string before the trigger is activated and releases the isolation sleeve from the isolation string after the trigger is activated, wherein the trigger comprises: a piston collar having a solid cylindrical portion attached to the isolation sleeve and a finger portion having at least one finger, wherein the at least one finger has a head at a distal end; and at least one recess in the isolation string, wherein the head of the at least one finger is engaged in the at least one recess; a cylindrically shaped pop lock positioned adjacent the head of the at least one finger so that the head is between the pop lock and the recess, wherein the pop lock secures the head relative to the recess; and a latch attached to the service tool which couples with the pop lock, wherein the trigger is activated by removing the pop lock from the position adjacent the head; and an activation tool which allows the isolation sleeve to move to a closed position, wherein the activation tool is a piston driven by a hydrostatic chamber which comprises lower pressure within the hydrostatic chamber than without, and wherein the piston moves the isolation sleeve from the open to the closed position.

According to an even further aspect of the invention, there is provided a process for isolating a production zone within a well, the process having the steps of: installing an isolation string and a service tool simultaneously within the well adjacent the production zone, wherein the isolation string comprises an isolation sleeve; locking the isolation sleeve in an open position during the installing an isolation string, wherein the open position allows fluid communication between the production screen and an interior portion of the isolation string; unlocking the isolation sleeve with the service tool; and moving the isolation sleeve to a closed position, wherein the closed position prevents fluid communication between the production screen and an interior portion of the isolation string.

Other and further features and advantages will be apparent from the following description of presently preferred embodiments of the invention, given for the purpose of disclosure and taken in conjunction with the accompanying drawings.

BRIEF DESCRIPTION OF THE DRAWINGS

The present invention is better understood by reading the following description of non-limitative embodiments, with reference to the attached drawings wherein like parts in each of the several figures are identified by the same reference character, and which are briefly described as follows.

DETAILED DESCRIPTION OF THE PREFERRED EMBODIMENTS

Figure 1A:
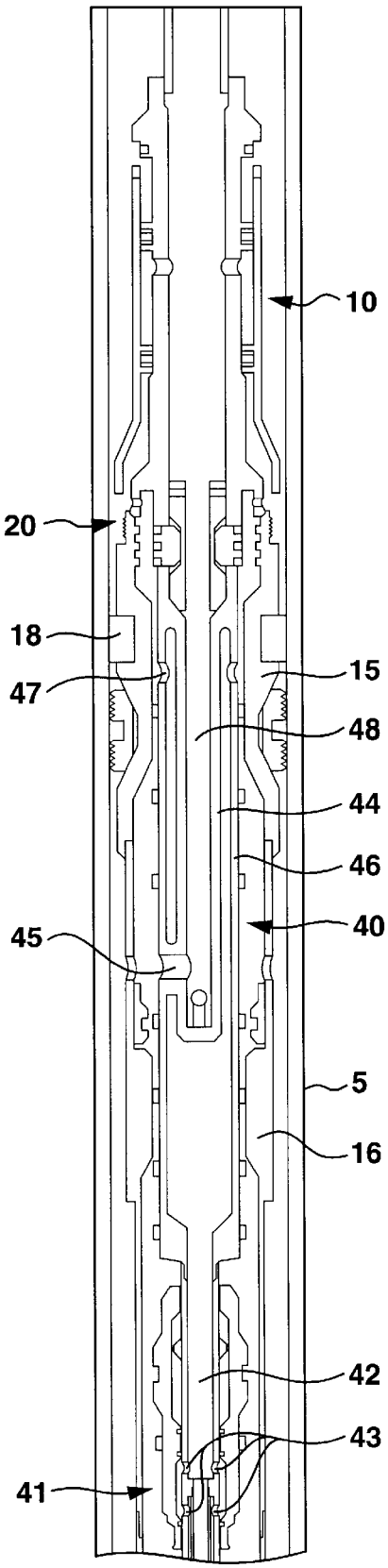
FIGS. 1A and 1B are cross sectional views of a service tool with a locking stick joint, in the run-in position in combination with an isolation string, of the present invention.

Referring now to the drawings, the details of preferred embodiments of the present invention are graphically and schematically illustrated. Like elements in the drawings will be represented by like numbers, and similar elements will be represented by like numbers with a different lower case letter suffix.

Figure 1B:
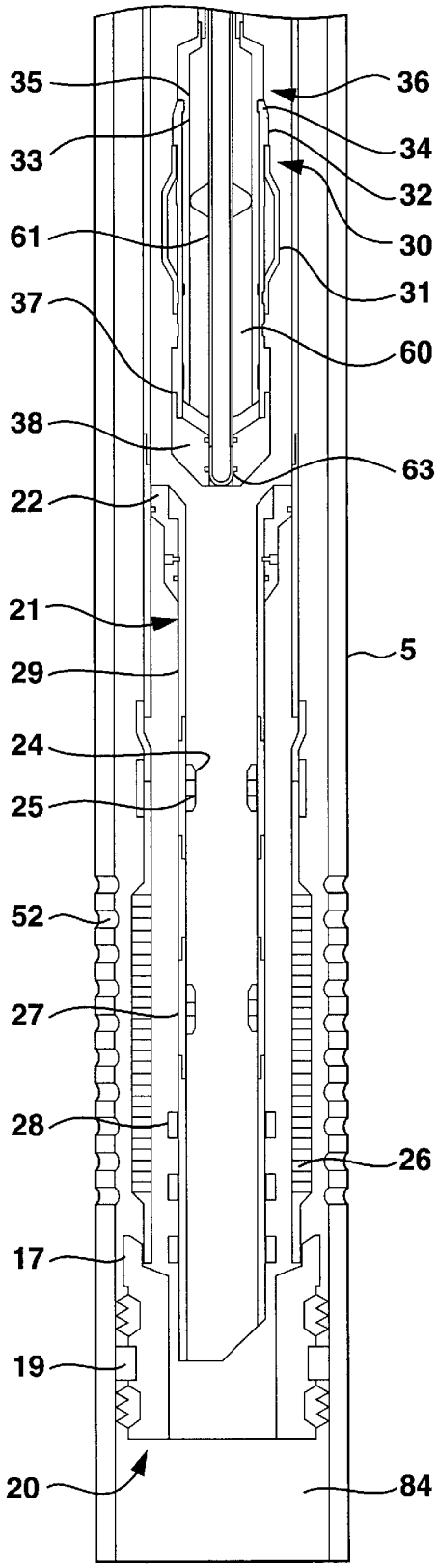

Referring now to FIGS. 1A and 1B, a first embodiment of the invention is illustrated in which depict a cross sectional view of a service tool 10 in combination with an isolation string 20 inside of a well casing 5. The service tool 10 and isolation string 20 are designed to work in tandem to perform completion functions and leave the production zone in an isolated state for subsequent production. The service tool 10 comprises a crossover assembly 40, a fracture port assembly 41, and an activation tool. In embodiment depicted in FIGS 1A and 1B, the activation tool is a locking slick joint 30. Significant characteristics of this first embodiment are that there is no wash pipe which extends below the service tool 10 and through the isolation string 20. Also, the locking slick joint 30 may be manipulated to open a through channel which allows fluid to travel from below the service tool 10, up through the channel in the service tool 10, and up through the service string. This prevents the service tool 10 from becoming "stuck" in the isolation string 20 after closure of the concentric isolation sleeve 21 due to vacuum pressure below the service tool 10. The service tool 10 is first described and then the isolation string 20.

Near the top of the significant portion of the service tool 10, there is the crossover assembly 40 which is typical of those known in the art. An example is disclosed in Rebardi et al. U.S. Pat. No. 5,865,251. The crossover assembly 40 provides control of fluid flow paths in cooperation with other components inserted into the wellbore. It has an inner pipe 44 that extends for a portion of the proximal part of an outer pipe 46. The proximal end of the outer pipe 46 has outer holes 47 which allow fluid communication from the exterior of the outer pipe 46 to the interior. The inner pipe 44 defines a central lumen 48 which communicates through an aperture 45 to the exterior of the outer pipe 46 at a location intermediate the length of the outer pipe 46. As is known, the cross over assembly is used during gravel pack operations to deposit "gravel" between a production screen 26 of the isolation string 20 and perforations 52 in the well casing 5.

The fracture port assembly 41 defines a fracture port chamber 42 in communication with a plurality of fracture ports 43 which provide fluid communication with the locking slick joint 30. The fracture port assembly 41 may be shifted between an open position and a closed position. In the open position, fluid is allowed to flow through the fracture ports 43 during circulation of the gravel pack fluids. When it is desirable to fracture a production zone, the fracture port assembly 41 is shifted to a closed position so that the fracture ports 43 are closed. In the closed position, high pressure may be generated below the fracture port assembly 41 to fracture a production zone, as is well known.

The locking slick joint 30 comprises a locking slick joint outer sleeve 31, a locking slick joint female sleeve 32, and a locking slick joint male sleeve 33. The locking slick joint outer sleeve 31 is positioned around the outer radius of the locking slick joint female sleeve 32 and secures the locking slick joint female sleeve 32 around the locking slick joint male sleeve 33. A recess 35 is located on the outer radius of the locking slick joint male sleeve 33 formed to receive the mating ledge 34. The mating ledge 34 is located along a proximal, open end 36 of the locking slick joint female sleeve 32. Attached to the distal, closed end 37 of the locking slick joint female sleeve 32 is the locking slick joint tip 38. The locking slick joint male sleeve 33 is hollow in the inside and defines an annular passage 60. At the center of the annular passage 60 there is a locking slick joint plug 61 which extends, in the run-in position (see FIGS. 1A and 1B), from the distal end of the service tool 10 where the locking slick joint 30 is attached, through the center of the annular passage 60, and through a tip aperture 62. Within the tip aperture 62 there are tip seals 63 which completely seal the locking slick joint tip 38 when the locking slick joint plug 61 is in the tip aperture 62. In the extended position (see FIGS. 2A and 2B) the locking slick joint 30 provides a fluid passage from below the service tool 10 to above, as is described more fully below.

The isolation system of the present invention is comprised of an isolation string 20, a concentric isolation sleeve 21, an upper packer 18, and a lower packer 19. The isolation string 20 is formed to have an outer diameter capable of being positioned inside the well casing 5 and formed to have an inner diameter capable of receiving the service tool 10 inside the inner diameter of the isolation string 20. The isolation string 20 is comprised of an upper seal bore 15, a lower seal bore 16, an isolation pipe 23 a production screen 26, and a base seal bore 17. The upper packer 18 is positioned concentrically around the upper seal bore 15 of the isolation string 20, and the lower packer 19 is positioned concentrically around the base seal bore 17 of the isolation string 20; on opposite ends of the isolation string 20. The upper packer 18 and the lower packer 19 prevent fluid flow adjacent each packer in the region bounded by the outer radius of the isolation string 20 and the inner radius of the casing 5. The concentric isolation sleeve 21 is comprised of an isolation string collar 22, which is axially connected to an isolation tube 29. Affixed to the inner radius of the concentric isolation sleeve 21 are isolation sliding sleeves 24. Positioned on the outer radius of the isolation tube 29 are exterior concentric seal assemblies 28. The exterior concentric seal assemblies 28 are formed to provide a sealing surface between the outer radius of the isolation tube 29 and downhole of the base seal bore 17. The concentric isolation sleeve 21 is positioned within the isolation string 20, proximate to the production screen 26.

Figure 3:
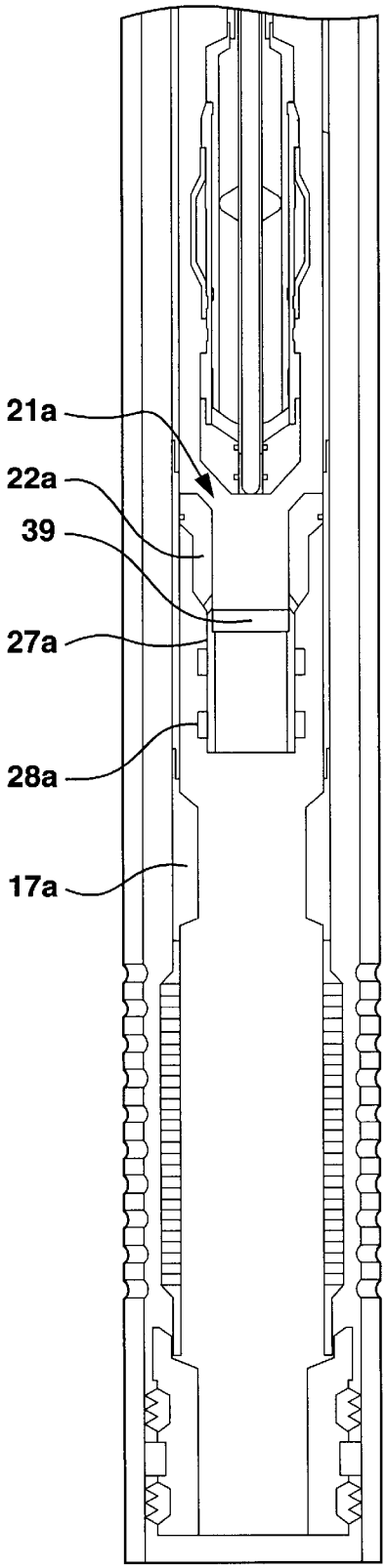
FIG. 3 is a cross sectional view of an alternative embodiment of a service tool with a locking stick joint in the run-in position, in combination with an isolation string, of the present invention.
Figure 4:
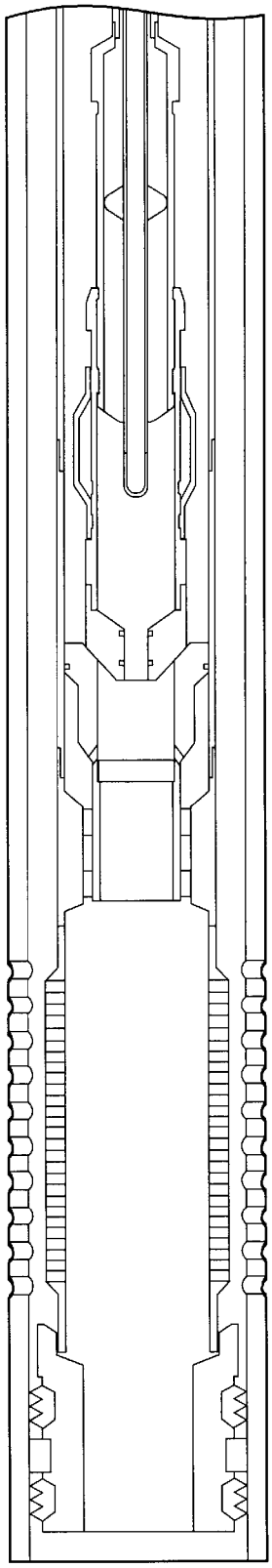
FIG. 4 is a cross sectional view of an alternative embodiment of a service tool with a locking stick joint in the set position, in combination with an isolation string, of the present invention.

FIGS. 3 and 4 illustrate an alternative concentric isolation sleeve 21*a*. The alternative concentric isolation sleeve 21*a* is comprised of an isolation tube 29*a* which is open at one end, and connected at its other end to an isolation string collar 22*a*. Seal assemblies 28*a* are positioned on the outer radius of the isolation tube 29*a*. A glass disk 39 is positioned inside the isolation tube 29*a* and prevents fluid flow through the isolation tube 29*a*. The alternative concentric isolation sleeve 21*a* is typically used on the producing zone that is located furthest downhole, i.e. no additional hydrocarbon producing zones exist past the point where the alternative concentric isolation sleeve 21*a* will be positioned.

Operation of the locking slick joint tool is typically performed during a gravel pack operation. Since gravel pack operations are well known in the art, a detailed description of gravel pack operations will not be provided herewith. A description of such operations is provided in Rebardi et al., U.S. Pat. No. 5,865,251, incorporated herein by reference. After gravel pack operations have been completed, and it is desired to isolate the section of the well that has been gravel packed or fractured, the locking slick joint tool is adjusted from the run-in position to the set or extended position.

Figure 5:
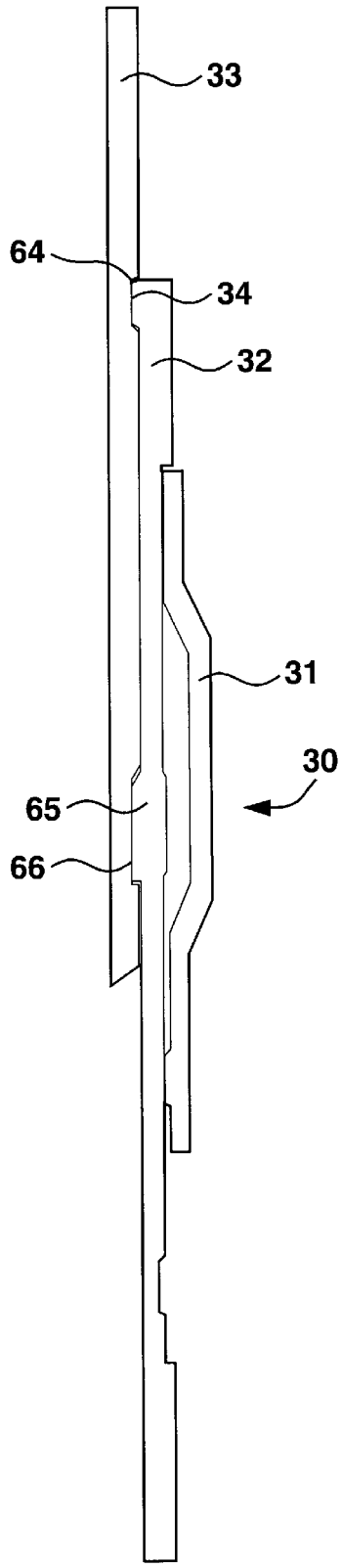
FIG. 5 is a cross sectional view of the sleeve components of the locking stick joint of the present invention.

The change in position is accomplished by retracting the service tool 10 up the well hole until the locking slick joint outer sleeve 31 contacts a shoulder of the lower seal bore 16. Additional force is then applied in retracting the service tool 10 until the locking slick joint outer sleeve 31 is moved along the locking slick joint female sleeve 32 towards the locking slick joint tip 38. Moving the locking slick joint outer sleeve 31 towards the locking slick joint tip 38 allows the mating ledge 34 of the locking slick joint female sleeve 32 to move out of the recess 35 formed on the outer radius of the locking slick joint male sleeve 33. Once the mating ledge 34 of the locking slick joint female sleeve 32 is moved out of the recess 35 the force being applied to retract the service tool 10 will slide the locking slick joint female sleeve 32 along the locking slick joint male sleeve 33, thereby extending the locking slick joint tool into the set position. The locking slick joint 30 is locked in the set position when the mating ledge 34 snaps into upper set recess 64 (see FIG. 5). The locking slick joint 30 is further held in the set position by lower mating ledge 65 which snaps into lower set recess 66. The lower mating ledge 65 is firmly held in the lower set recess 66 by the locking slick joint outer sleeve 31 when the outer sleeve 31 is moved into a lock position (see FIG. 2B). The locking slick joint outer sleeve 31 is shown in an unlock position in FIG. 5.

If it is desired not to actuate the concentric isolation sleeve 21 after the locking slick joint 30 has been placed in the set position, the locking slick joint 30 may be returned to its original run-in position. This is done by pulling up on the service tool 10 to draw the locking slick joint 30 up through the lower seal bore 16 and slacking back off to push the locking slick joint 30 back through the lower seal bore 16 from above. Since the locking slick joint outer sleeve 31 indicates on the lower seal bore 16, this action slides the outer sleeve 31 from a lock position (see FIG. 2B) to an unlock position (see FIG. 5). As the locking slick joint 30 moves further through the lower seal bore 16, this action dislodges the mating ledge 34 and lower mating ledge 65 from the upper set recess 64 and the lower set recess 66, respectively. The locking slick joint female sleeve 32 then slides axially along the locking slick joint male sleeve 33 until the mating ledge 34 snaps into recess 35. The locking slick joint outer sleeve 31 then squeezes through the lower seal bore 16 and the locking slick joint 30 is fully returned to the run-in position.

Figure 2A:
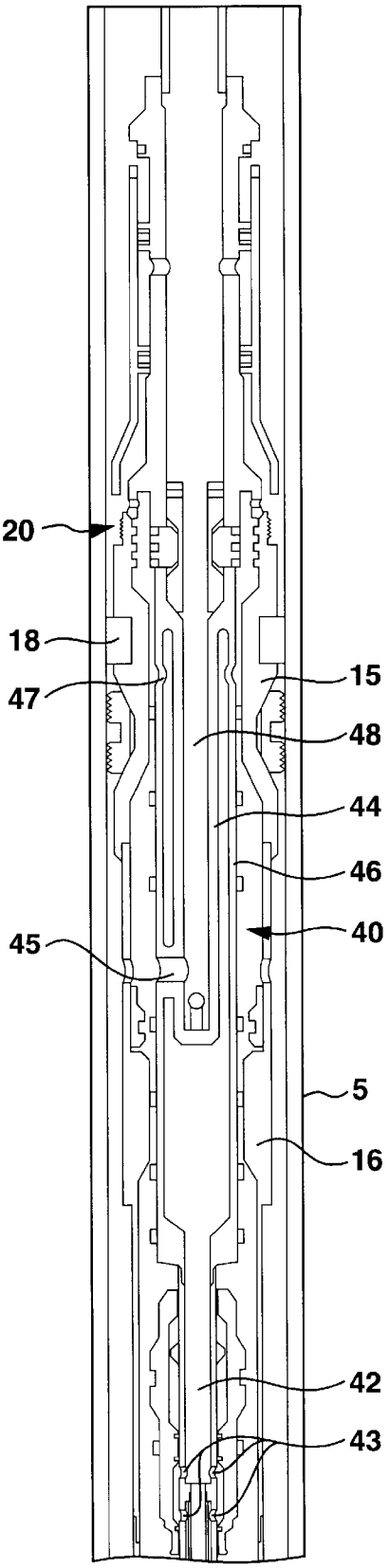
FIGS. 2A and 2B are cross sectional views of a service tool with a locking stick joint in the set position, in combination with an isolation string, of the present invention.
Figure 2B:
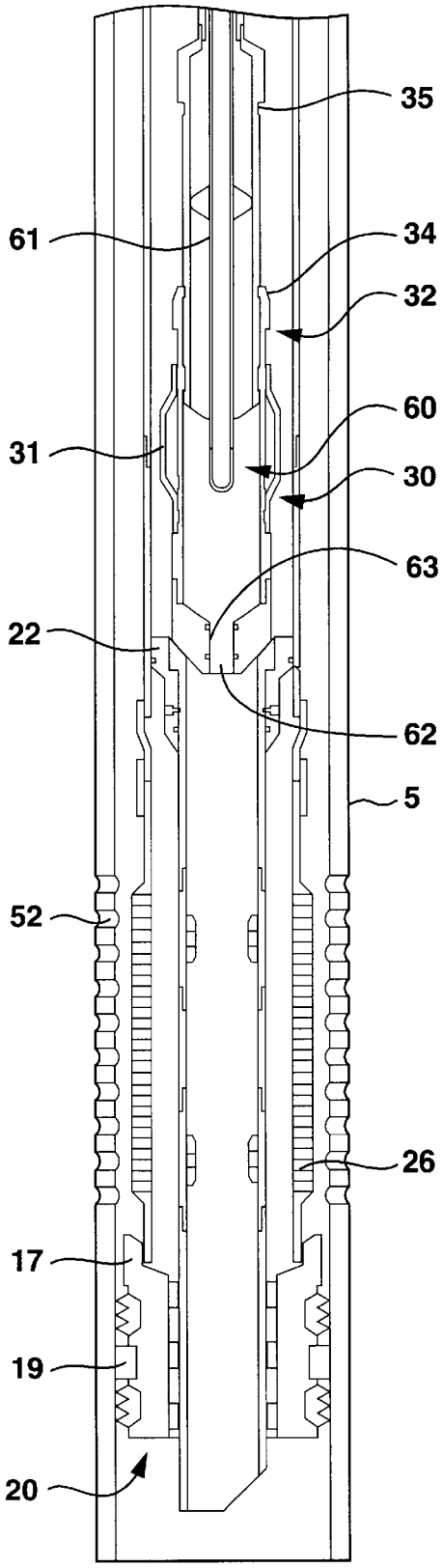

If it is desired to actuate the concentric isolation sleeve 21, the locking slick joint 30 is placed in the set position as described above. Once the locking slick joint tool is in the set position (see FIGS. 2A and 2B), the service tool 10 is then moved downward towards the concentric isolation sleeve 21. As seen in FIGS. 2 and 4, the locking slick joint tip 38 contacts the isolation string collar 22 (or 22*a*) and forces the concentric isolation sleeve 21 downward until the exterior concentric seal assemblies 28 are in contact with the base seal bore 17. In the case of the alternative embodiment, the exterior concentric seal assemblies 28*a* contact the intermediate seal bore 17*a*. Engaging the exterior concentric seal assemblies 28 (or 28*a*) with the base seal bore 17 (or intermediate seal bore 17*a*) prevents flow from the perforations 52 into the well bore 84, thereby isolating the hydrocarbon producing zone adjacent the perforations 52.

With the production zone completely scaled, the service tool 10 is withdrawn from the isolation string 20 by simply retracting the service string up through the wellbore. Since the locking slick joint plug 61 is withdrawn from the tip aperture 62 when the locking slick joint 30 is in the set position 30, a fluid flow channel is created within the service tool 10. As the service tool 10 is withdrawn, fluid flows from outside the service tool 10, above the upper packer 18. In particular, fluid flows through the outer holes 47 to the interior of the outer pipe 46 of the crossover assembly 40. This fluid then flows to the fracture port chamber 42 of the fracture port assembly 41. Next, the fluid passes through the fracture ports 43 (if the ports are open as shown in FIG. 2A) and into the annular passage 60 of the locking slick joint 30. Finally, the fluid flows from the annular passage 60, through the tip aperture 62, and into the space within the closed concentric isolation sleeve 21 (see FIG. 2B). This prevents the service tool 10 from "sticking" in the isolation string 20 due to a vacuum created below the service tool 10 when removal of the service string is attempted.

If hydrocarbons are later desired to be produced from the zone adjacent the perforations 52 the isolation sliding sleeves 24 can be moved until the isolation sliding sleeve apertures 25 are in alignment with the isolation tube apertures 27. If the perforations 52 are located next to the alternative concentric isolation sleeve 21*a* then the glass disk 39 will can be broken thus allowing fluid flow through the glass disk 39 into the well bore 84. The glass disk 39 may be broken by hydraulic pressure, dropping a ball, acoustics, intelligent methods, etc.

At any time after the production is isolated with the isolation string 20 as described above, the isolation string 20 of the first embodiment of the invention may be withdrawn from the wellbore with a separate retrieval tool which run into the wellbore on a subsequent trip.

FIGS. 6 (A–G) through 12 (A–J) depict, in cross sectional view, a second embodiment of the invention. In this embodiment, the activation tool is a release tool 100. This second embodiment also comprises a hydrostatic chamber 104 which enables movement of the isolation sleeve 102 from an open to a closed position upon release of the sleeve by the release tool 100. A trigger is used to hold the isolation sleeve 102 in an open position, until the trigger is activated to allow the hydrostatic chamber 104 to push the isolation sleeve 102 into a closed position. FIGS. 6A through 6G illustrate the invention at the initial stage of operation. FIGS. 7A through 7G illustrate the invention at a subsequent stage of operation and so forth. These stages of operation will be described more fully below. Briefly, the isolation sleeve 102 is shown in an open position in FIGS. 10E–10J and shown in a closed position in FIGS. 11E–11J.

The isolation system of the second embodiment is comprised of an isolation string 101, and a service tool 138. Like the first embodiment, the service tool 138 and isolation string 101 are run into the wellbore simultaneously. Once the production screen 26 of the isolation string 101 is adjacent the perforated portion of the casing, the isolation string 101 is set in the casing with an upper packer 18 and a lower packer (not shown).

In the second embodiment of the invention, the service tool 138 is similar to that of the first embodiment in that the upper or proximal parts comprise devices necessary for the gravel pack processes. In a lower or more distal portion of the service tool 138, the release tool 100 is attached (see FIG. 6C). The release tool 100 is connected to the service tool 138 by a release tool shear pin 142. Of course, since the release tool 100 is connected to the service tool 138, the release tool 100 is positioned within the isolation string 101 in the run-in position and during gravel pack procedures. In the embodiment shown, a wash pipe 112 extends from the distal or lower end of the service tool 138. In the run-in position, the end of the wash pipe 112 extends to about the bottom of the production screen 26; the remainder of the service tool 138 is above the production screen 26.

The isolation string 101 is secured to the well casing (not shown) by packers in a manner that is usual and customary in the art. In a lower portion of the isolation string 101 there is a production screen 26 (see FIGS. 8G–8H). Inside the isolation string 101 and adjacent the production screen 26, there is an isolation sleeve 102 (see FIGS. 8E–8H). The isolation sleeve 102 comprises a piston 126, a hydraulic dampener 118, seal tubing 124, and a wrap screen 128. All of these parts are axially connected to form an elongated tubular section.

In this embodiment, the trigger is comprised of a piston collar 106 that is secured to the upper portion of the piston 126, and is positioned on the outer radius of the piston 126, thus forming a band between the isolation string 101 and the piston 126 (see FIGS. 6E–10E). A more detailed drawing of the piston collar 106 is shown in FIG. 13. A lower section 106*a* of the piston collar 106 is completely cylindrical while the upper portion 106*b* of the piston collar 106 has a plurality of upwardly projecting fingers 107. At the upper distal ends of the fingers 107, the fingers 107 each have a head 107*a* with threads thereon which mate with threads on shoulder 105 of the isolation string 101. The heads 107*a* of the fingers 107 are impinged against the shoulder 105 of the isolation string 101 by a pop lock 108. By impinging the heads 107*a* against the isolation string 101, the isolation sleeve 102 is secured to the isolation string 101, thereby preventing axial movement of the isolation sleeve 102 with respect to the isolation string 101. If the pop lock 108 is moved vertically from within the fingers 107 of the piston collar 106, the heads 107*a* are released and the piston collar 106 and the rest of the isolation sleeve 102 connected thereto are free to slide within the isolation string 101. The lower portion 106*a* of the piston collar 106 occupies a space between the isolation string 101 and the piston 126. Seals 109 are placed between the piston collar 106 and the isolation string 101, and between the piston 126 and the piston collar 106.

Figures 6A, 7A, 8A, 9A, 10A, 11A, 12A:
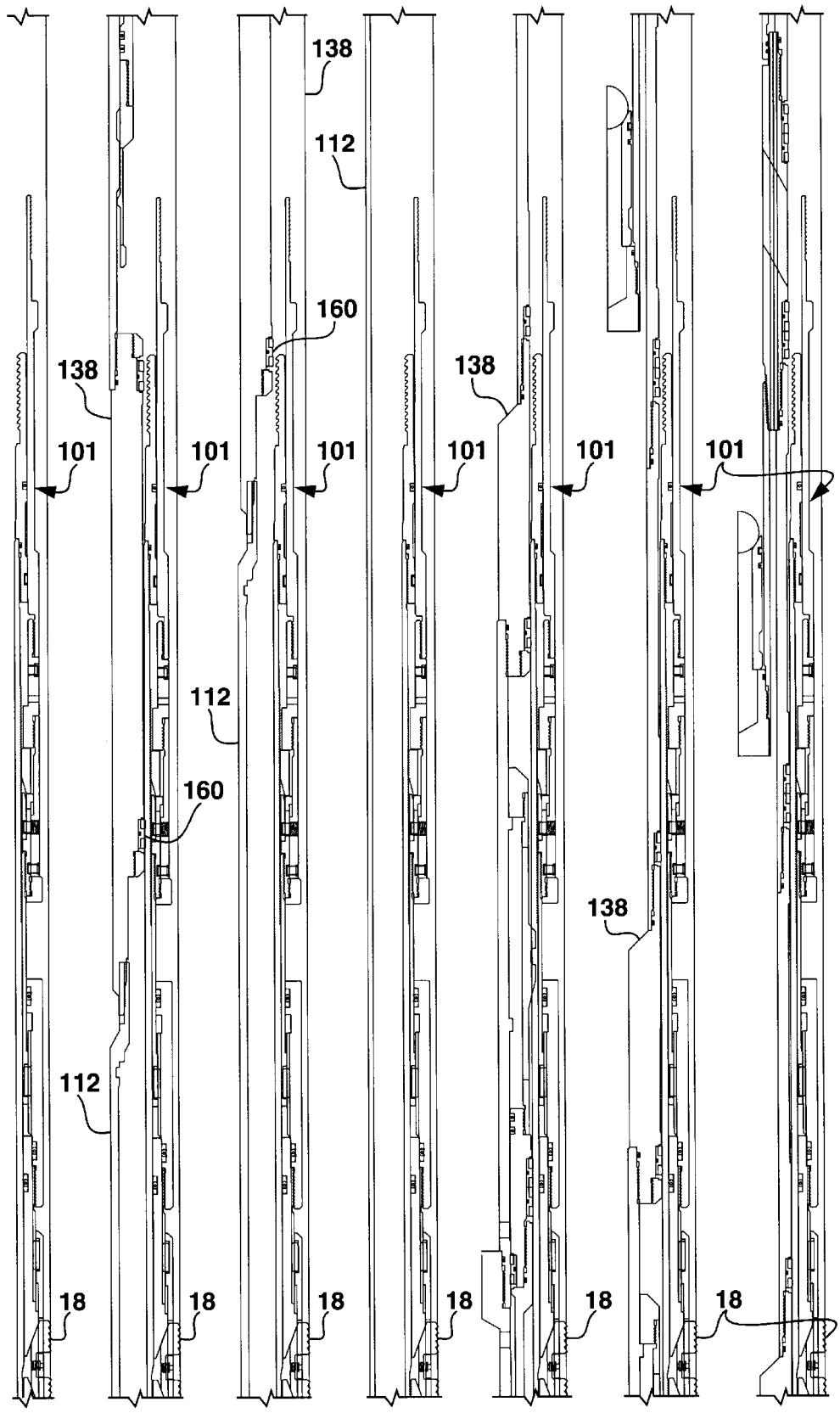
FIGS. 6 (A–G) through 12 (A–J) represent cross sectional views of an alternative isolation system in various stages of operation of the present invention.
Figures 6B, 7B, 8B, 9B, 10B, 11B, 12B:
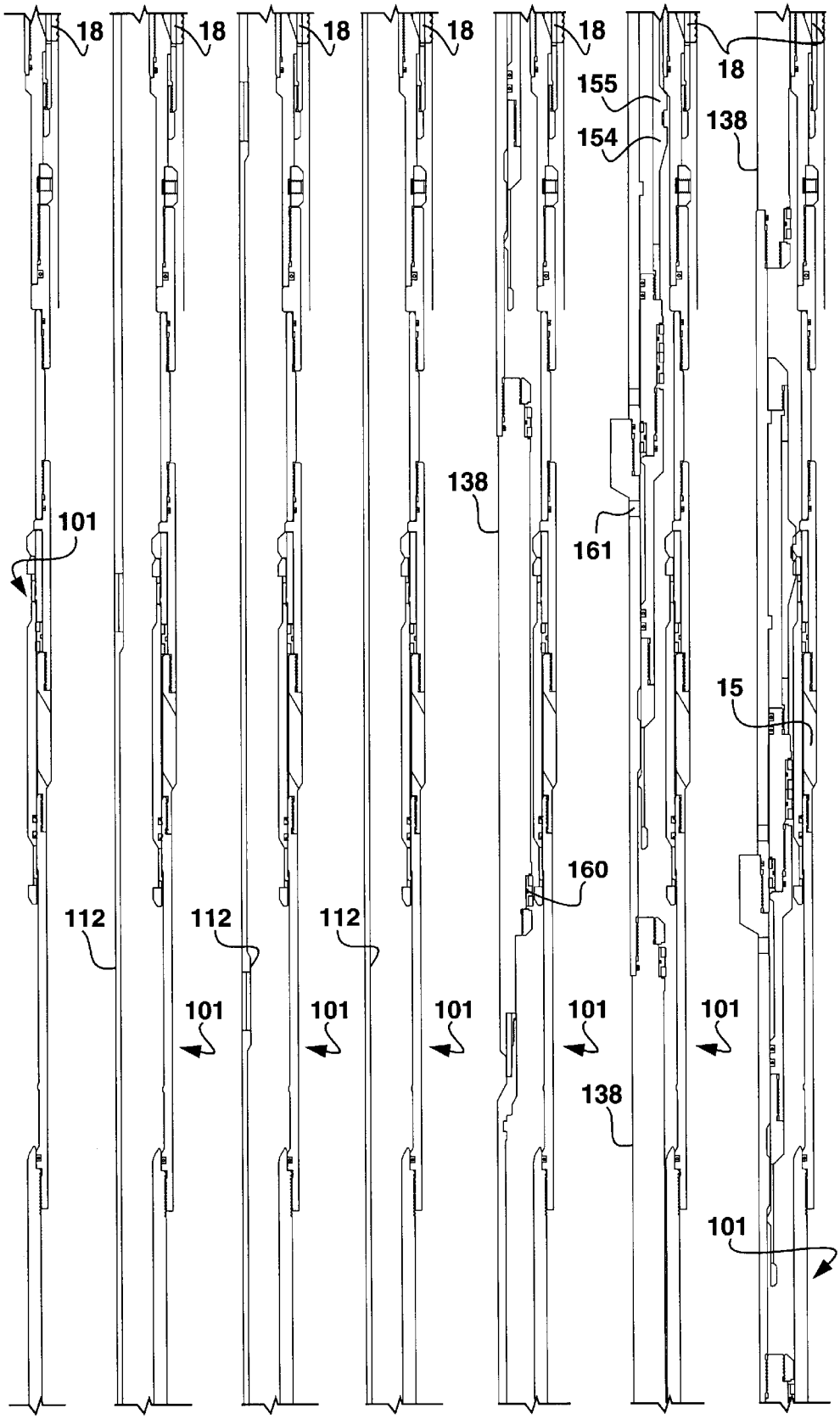
Figures 6C, 7C, 8C, 9C, 10C, 11C, 12C:
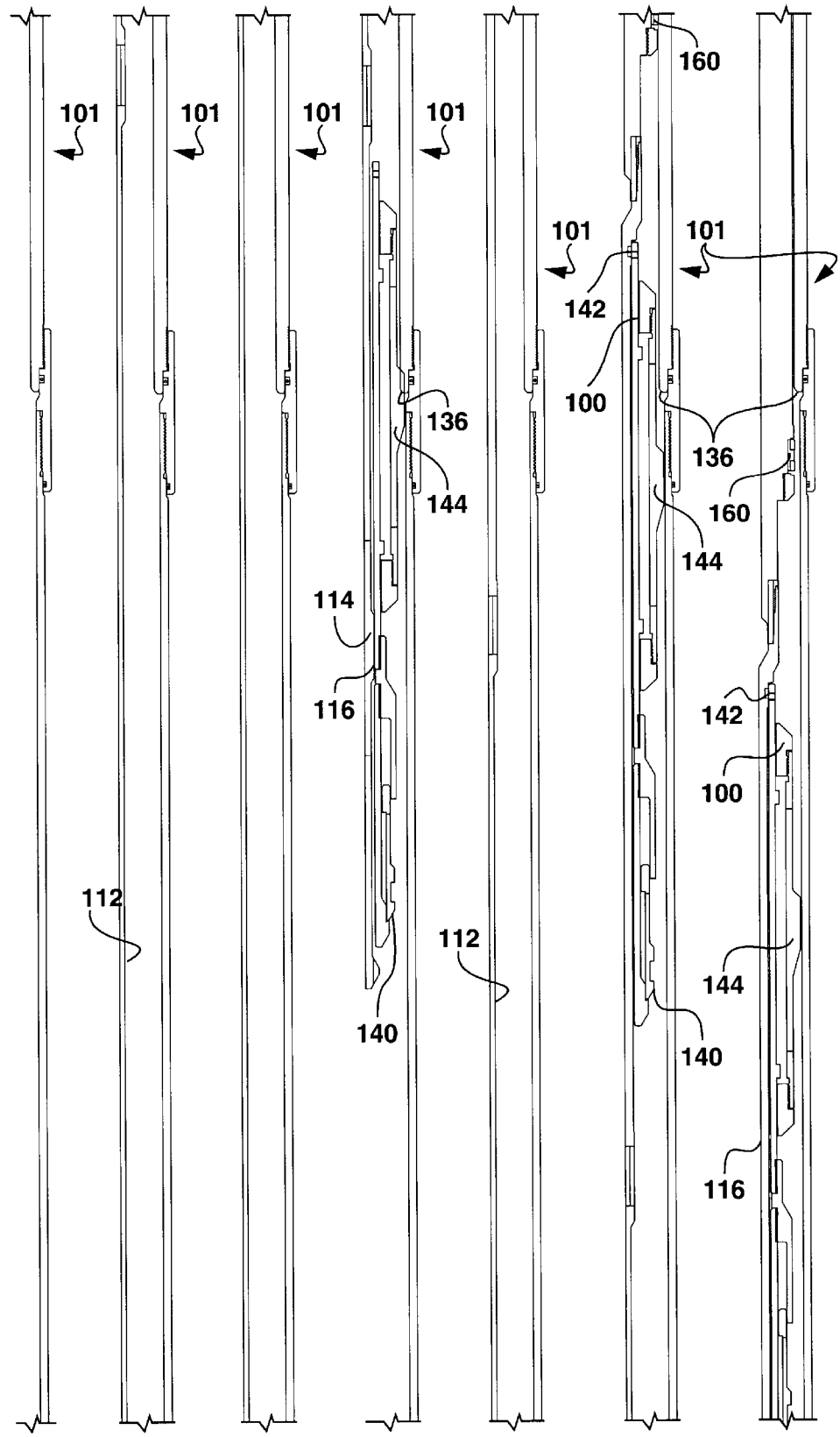
Figures 6D, 7D, 8D, 9D, 10D, 11D, 12D:
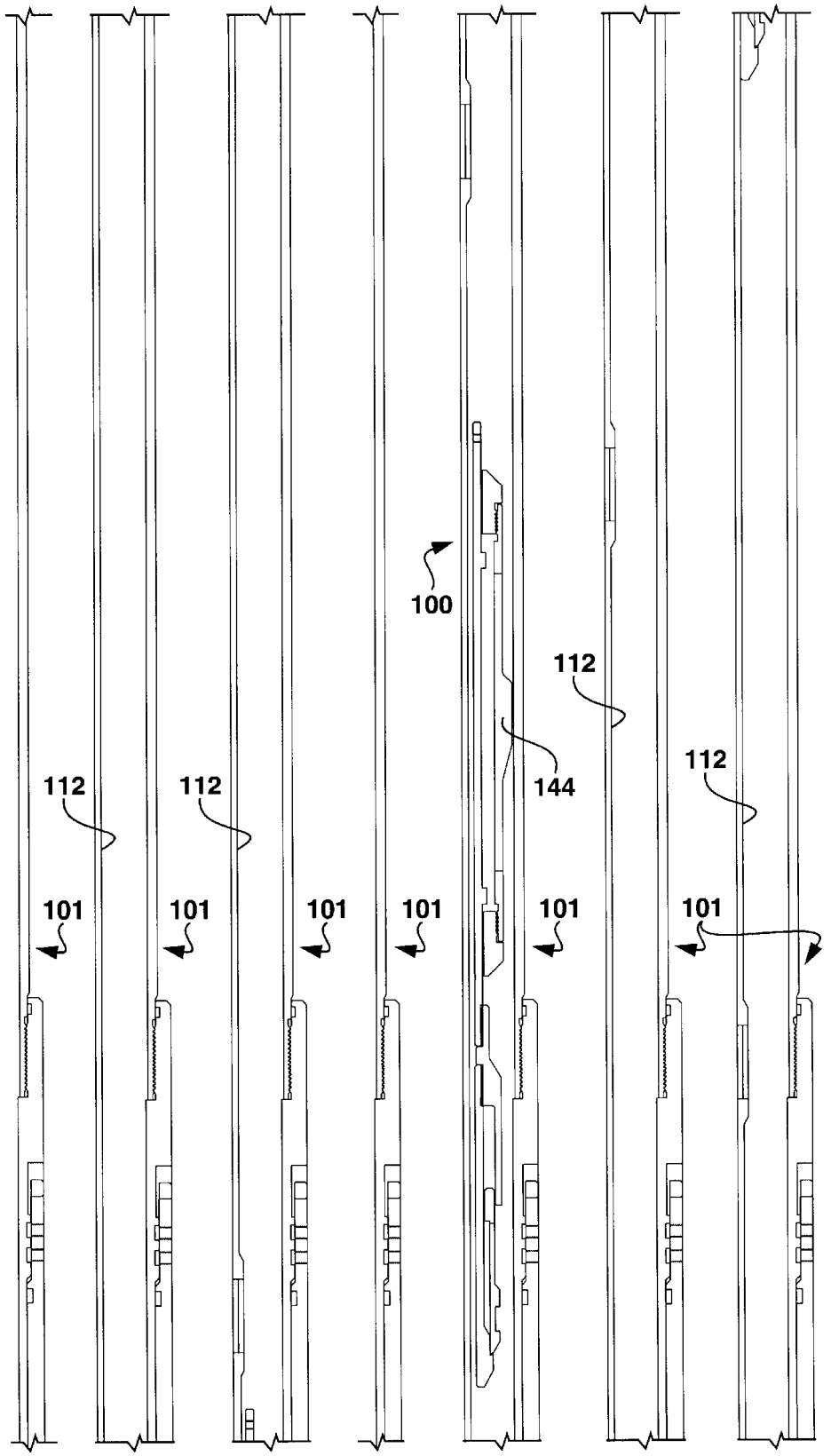
Figures 6E, 7E, 8E, 9E, 10E, 11E, 12E:
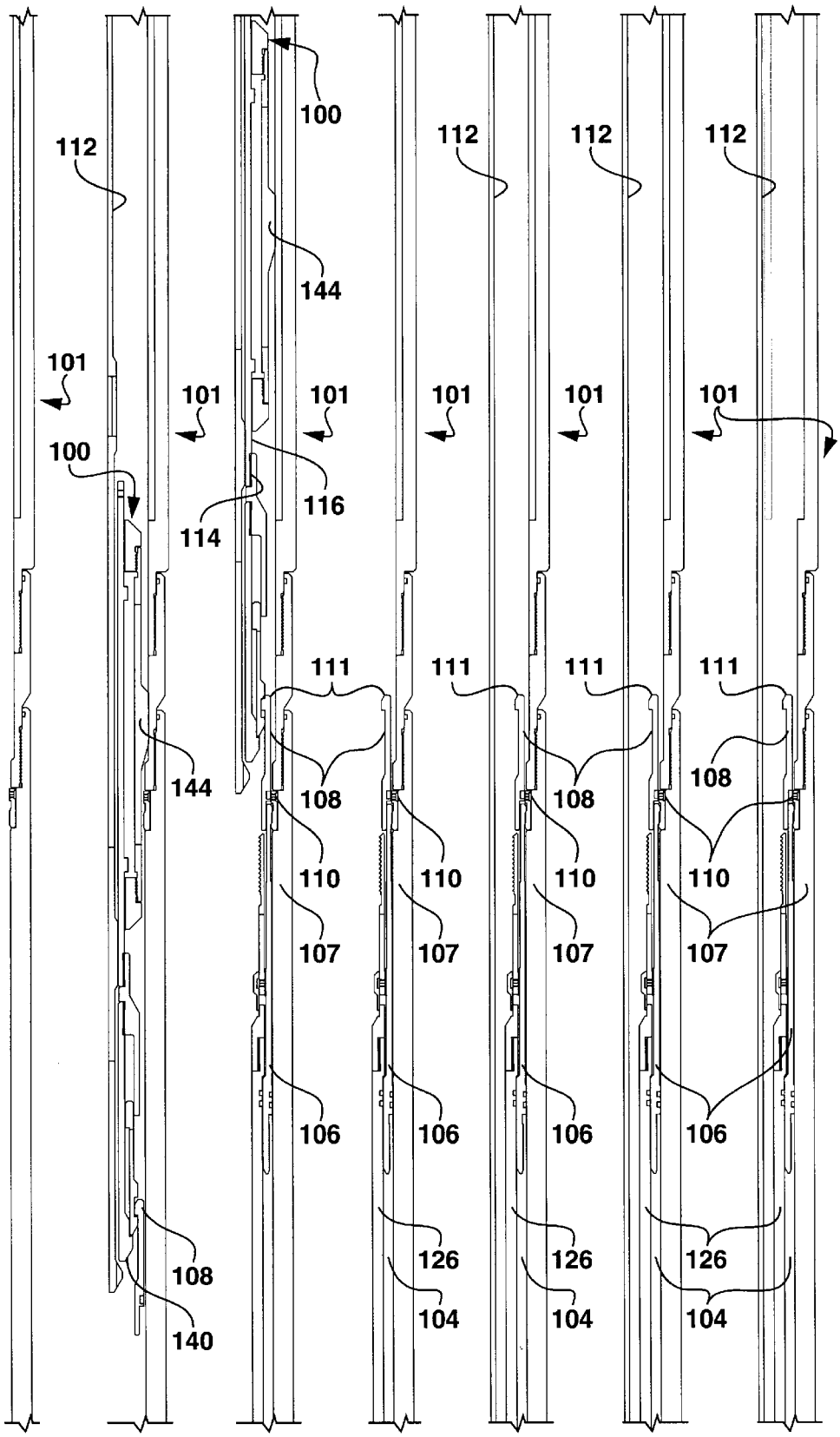
Figures 6F, 7F, 8F, 9F, 10F, 11F, 12F:
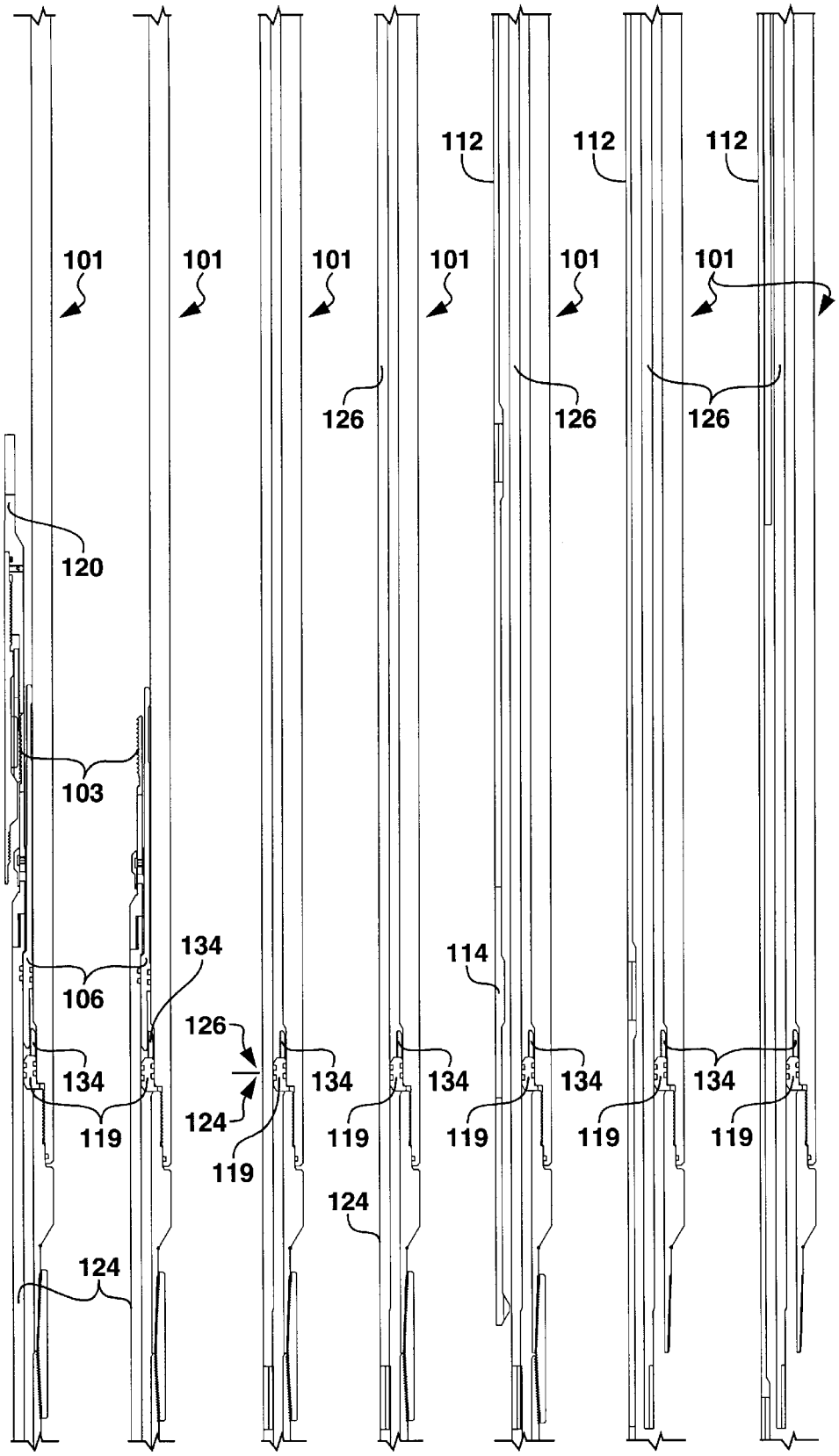

The outside diameter of the piston 126 is smaller than the adjacent inside diameter of the isolation string 101 so that the space between forms a hydrostatic or atmospheric chamber 104 (see FIGS. 8E–8F). The top end of the hydrostatic chamber 104 is sealed by the piston collar 106 as described above. The lower end of the hydrostatic chamber 104 is sealed by a ring seal 119 (see FIGS. 6F–12F). The ring seal 119 has seals on its inner diameter and outer diameter surfaces for sealing against the piston 126 and the isolation string 101, respectively. Since the piston 126 and the isolation string 101 are assembled at the surface before the system is lowered into the wellbore, the air inside the hydrostatic chamber 104 is at or close to standard atmospheric pressure. Once lowered into the wellbore, surrounding pressures become significantly greater than standard atmospheric pressure. This pressure differential provides a closure force for sliding the isolation sleeve 102 into a closed position as described below.

Figures 6G, 7G, 8G, 9G, 10G, 11G, 12G:
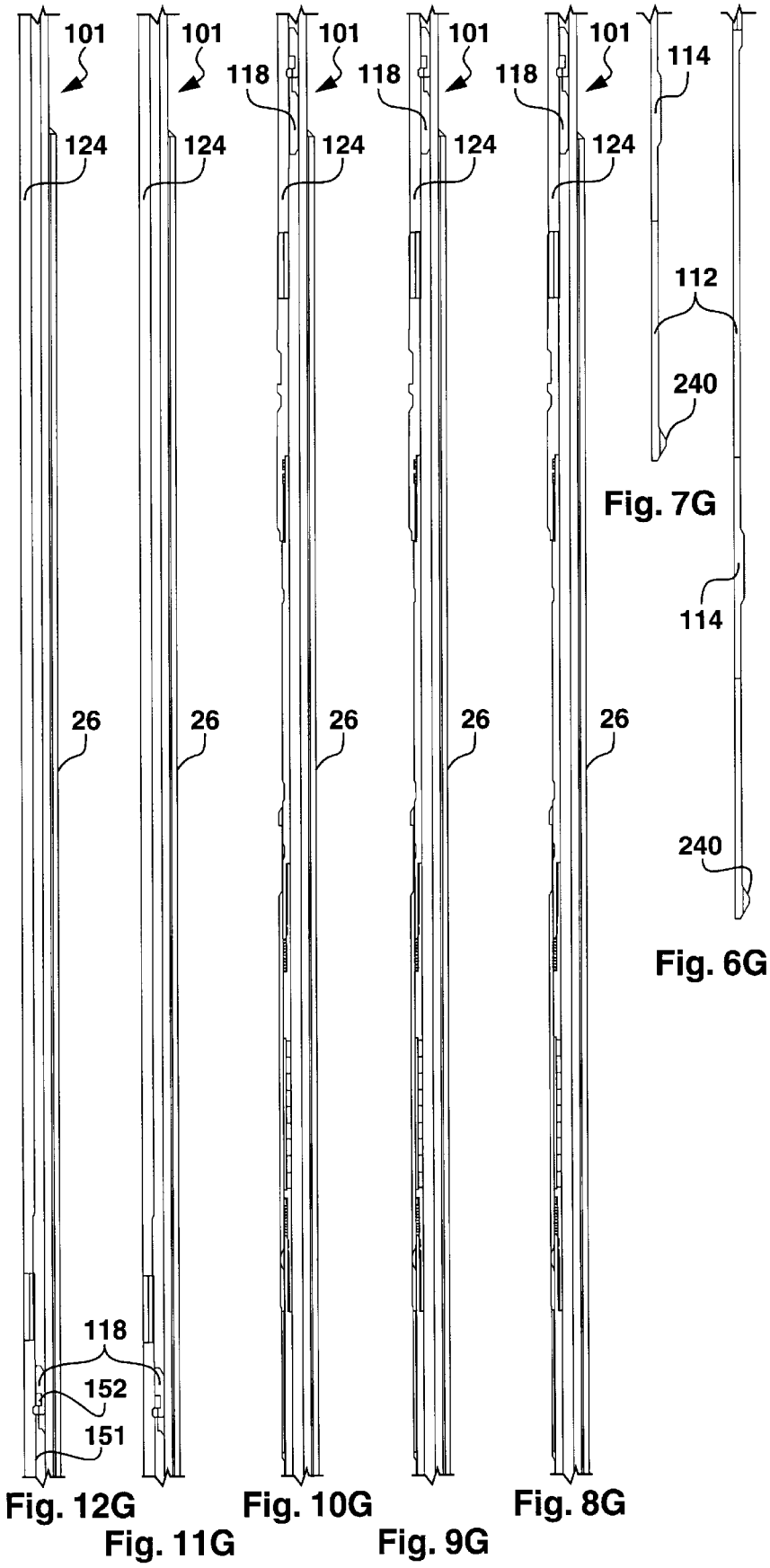
Figures 8H, 9H, 10H, 11H, 12H:
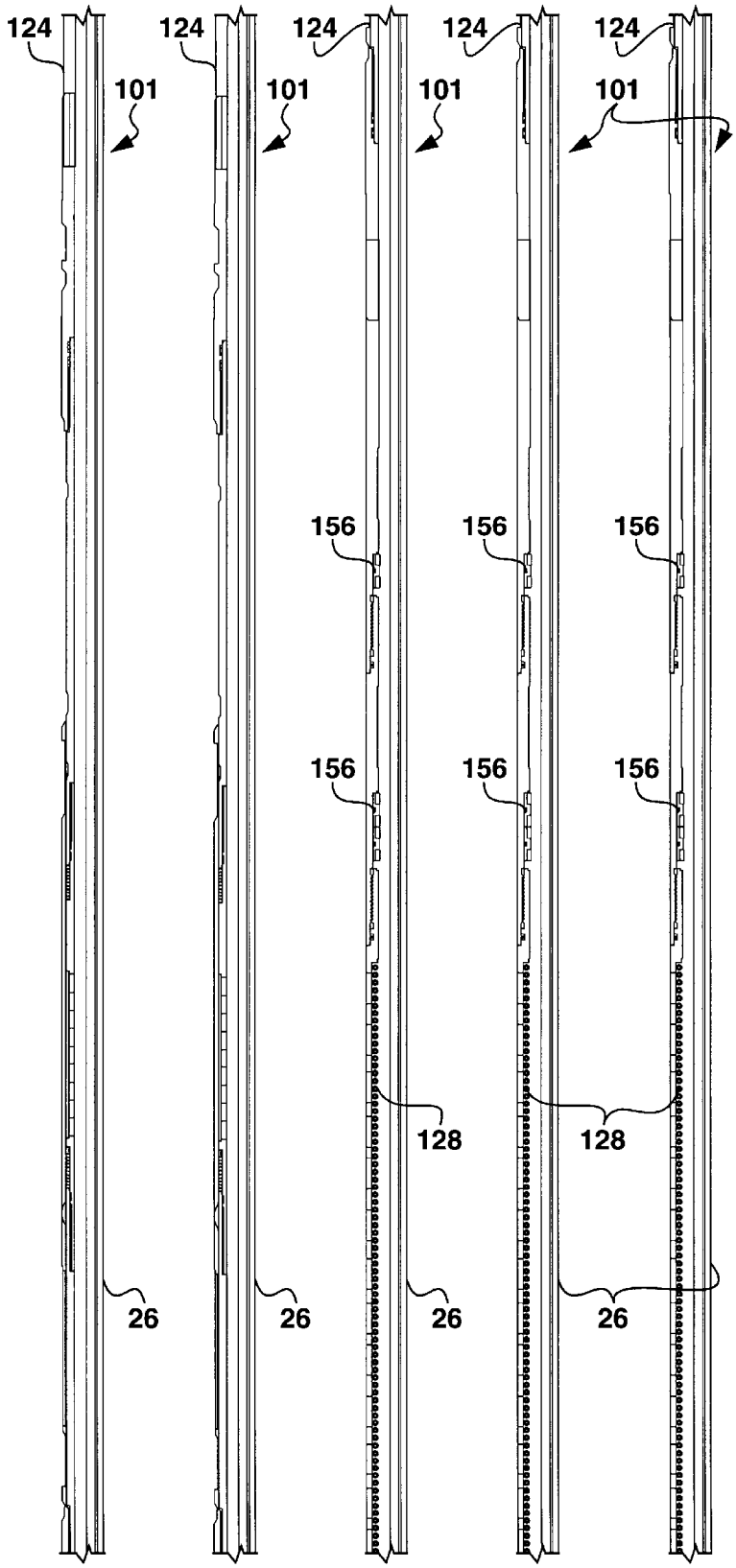
Figures 8I, 9I, 10I, 11I, 12I:
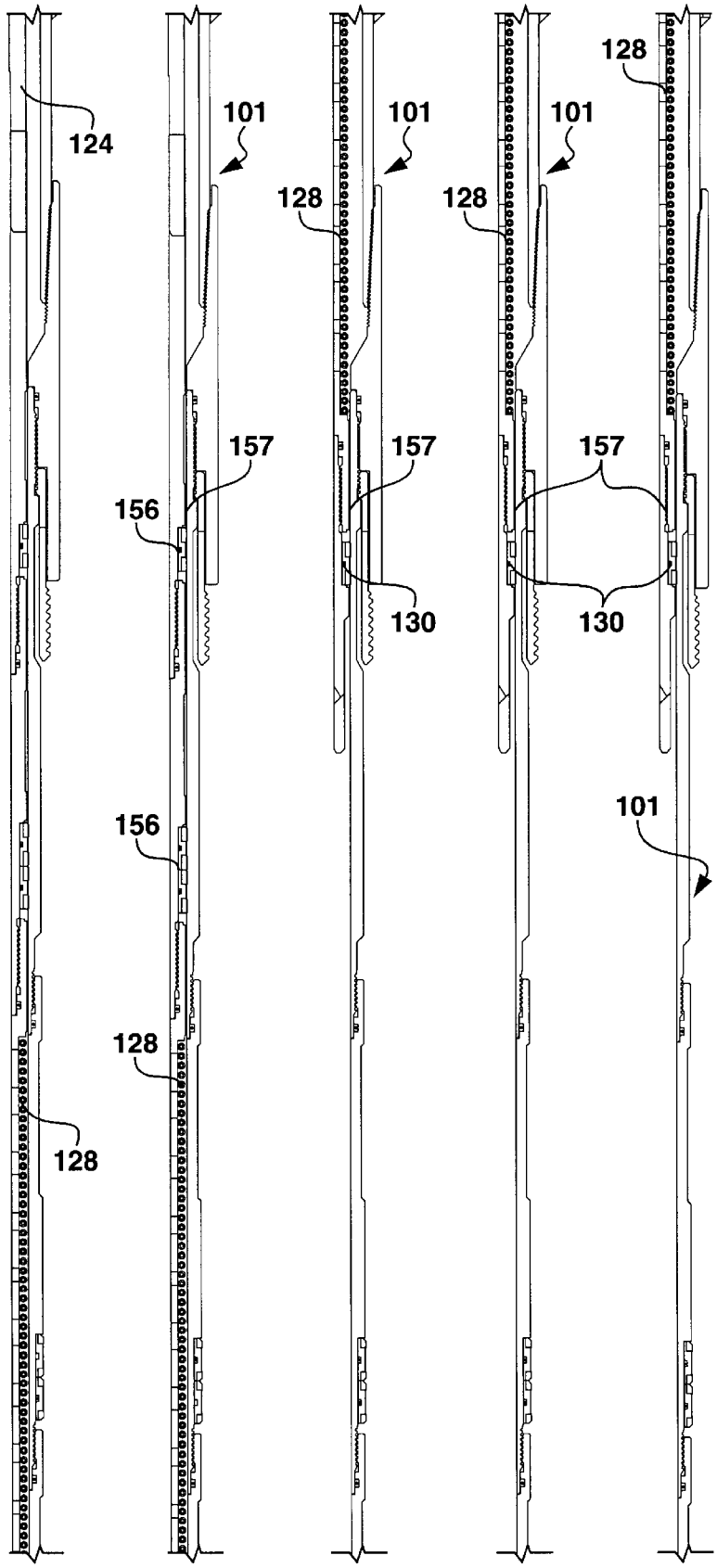
Figures 8J, 9J, 10J, 11J, 12J:
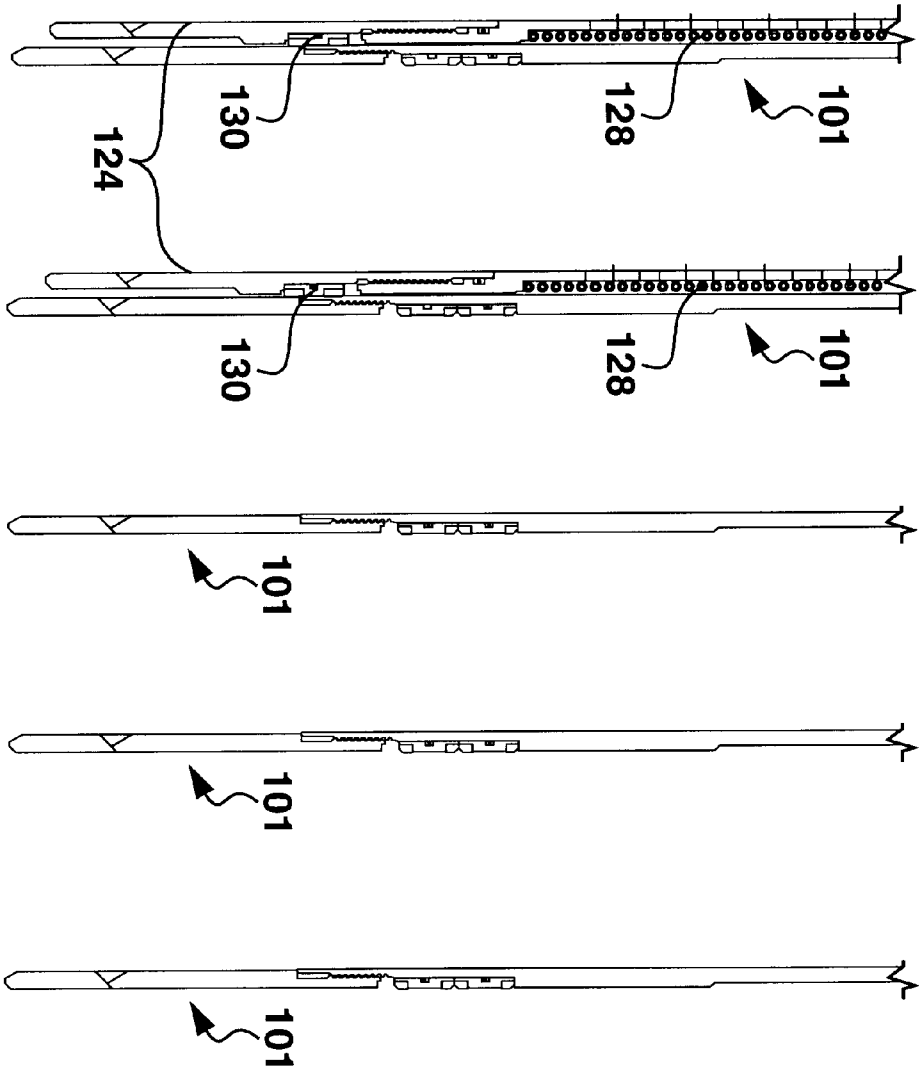
Figure 15:
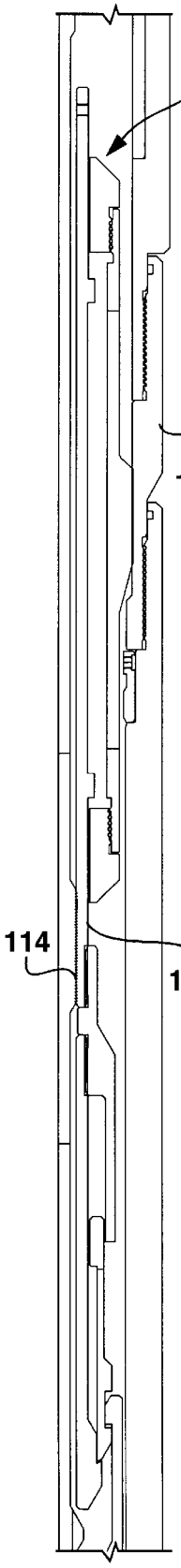
FIGS. 13 through 15 represent enlarged cross sectional views of the alternative isolation system of the present invention.
Figure 13:
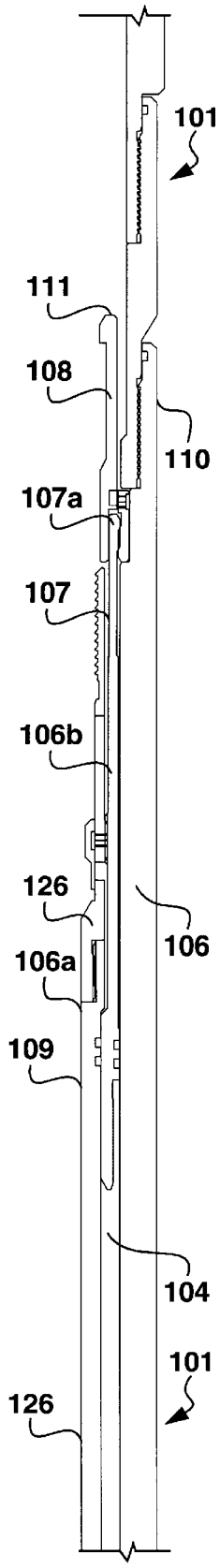

The seal tubing 124 of the isolation sleeve 102 defines the section of the isolation sleeve 102 that is downhole of the ring seal 119 and "seals" the inside of the isolation sleeve 102 from fluid flow through the production screen 26 (see FIG. 8F–8H). According, a particular section of the isolation sleeve 102 could be defined as the piston 126 during one stage of operation, and defined as seal tubing 124 during a subsequent stage of operation (see FIG. 8F–12F). Below the seal tubing 124, the wrap screen 128 extends to form the lowest most distal end of the isolation sleeve 102. In the open position, seal tubing seals 130 engage the seal surface 157 to ensure that all production fluids flow through the wrap screen 128. A hydraulic dampener 118 is located below the hydrostatic chamber 104 between the seal tubing 124 and the isolation string 101 (see FIGS. 8G–12G). The hydraulic dampener 118 serves to regulate the speed at which the isolation sleeve 102 closes upon release by the pop lock 108. The hydraulic dampener 118 comprises two parts, a dampening ring 151 and a lock ring 152, both of which are secured to the outer diameter of the seal tubing 124. When locked, these rings are unable to slide in the axial direction relative to the seal tubing 124. When locked in the position shown in FIGS. 8G–12G, fingers with heads (similar to the piston collar 106 described above) of the dampening ring 151 are positioned so that the heads protrude into an annular slot in the outside diameter of the seal tubing 124. The lock ring 152 is placed around the heads of the dampening ring 151 to secure the heads in the slot. The outer diameters of the dampening and lock rings 151 and 152 are slightly smaller than the inside diameter of the adjacent portion of the isolation string 101. This difference in diameters allows a small amount of fluid to pass from below the hydraulic dampener 118 to above while the isolation sleeve 102 slides from the open to the closed position. Since fluid flow is restricted through the narrow annular space, movement of the isolation sleeve 102 is restricted. This reduces opportunities for the isolation sleeve 102 to become damaged during closure.

The process for isolating the production zone after the gravel pack operation will now be described.

FIGS. 6A through 6G illustrate as position of the service tool 138 relative to the isolation string 101 immediately after "gravel" is packed around the outside of the production screen 26. In fact, since the service tool 138 has been pulled up relative to the isolation string 101, the gravel pack sleeve 153 is closed (see FIG. 6B).

In FIGS. 7A through 7G, the service tool 138 is shown in a reversing position. As is known in the art, completing fluid is cycled down the outside of the service tool 138 to flush the gel/propant of the gravel pack procedure back up through the inside of the service tool 138. In this position, gravel pack collet 154 has indicated on a gravel packer shoulder 155 so the operator will know the exact location of the service tool 138. After completion of the reversing procedure, the operator pulls the service tool 138 further up in the wellbore until the release tool indicator collet 144 indicates against the seal port shoulder 136 (see FIG. 7C). When the release tool indicator collet 144 contacts the seal port shoulder 136 the service tool 138 operator is informed as to the location of the release tool 100. Continued upward force on the service tool 138, against the unmoving seal port 136, causes the release tool shear pin 142 to fracture thereby freeing the release tool 100 from the service tool 138 allowing the release tool 100 to "free float" inside the well bore (see FIG. 8D).

The position of the devices immediately after release of the release tool 100 is shown in FIG. 8A–8J. Due to the force of gravity, the release tool 100 has fallen in the space between the wash pipe 112 and the isolation string 101.

Figure 14:
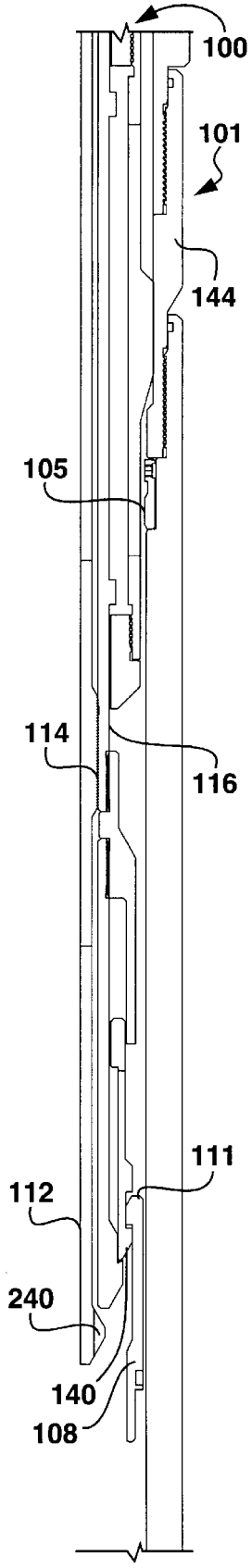

In FIGS. 9A–9J, the release tool 100 is shown reattached to the service tool 138. To reattach the release tool 100 to the washpipe 112 of the service tool 138, the service tool 138 is raised until a wash pipe collet 114 contacts a release tool capture collet 116 (see FIG. 9C). The service string 138 is raised until the release tool indicator collet 144, which is on the outside diameter of the release tool 100, indicates against the seal port shoulder 136 on the isolation string 101. Continued upward movement of the service tool 138 results in the wash pipe collet 114 fully mating with the release tool capture collet 116 to secure the release tool 100 to the wash pipe 112. This position is shown in greater detail in FIG. 14.

In FIGS. 10A–10J, the service tool 138 is again set down in the wellbore to activate the trigger. In this embodiment, the service tool 138 is lowered to a position where the release tool 100 is inserted into the upper rim of the pop lock 108 (see FIG. 10E). The service tool 138 comprises a release tool latch 140 which contacts the pop lock 108 (FIG. 10E). The upper ring of the pop lock 108 has a pop lock lip 111 which is engaged by a release tool latch 140 on the release tool 100. When the release tool latch 140 is inserted into the pop lock lip 111, the parts snap into engagement so that the opposing shoulders of the parts prevent slippage of the parts when the service tool 138 is again pulled back up the wellbore. These parts are shown in greater detail in FIG. 14. With the release tool 100 and the pop lock 108 engaged, the operator closes the isolation sleeve 102 to isolate the gravel packed production zone by pulling the service tool 138 further up the wellbore. This action pulls the pop lock 108 upward relative to the piston collar 106 to release the fingers 107 of the piston collar 106 as described above. Shearing the pop lock shear pin 110 disengages the pop lock 108 from the isolation string 101 thus allowing the pop lock 108 to slide upward with the release tool 100. The isolation sleeve 102 is forced downward by gravitational forces in addition to the pressure differential between the wellbore pressure and the standard atmospheric pressure inside the hydrostatic chamber 104.

In alternative embodiments, a trigger is activated by any means known in the art. For example, different mechanical tools may be used to release a latch sleeve to unlock the isolation sleeve similar to the trigger shown in the second embodiment of the invention. Next, hydraulic pressure sensitive devices may be used as a trigger so that the operator controls the trigger through downhole pressure differentials. Further, a ball seat trigger is possible so that the trigger is activated by a dropped ball. A still further illustrative embodiment uses intelligent methods, such as acoustics, pressure signals, battery packs, electronics, etc. to communicate with and activate a trigger. Examples of intelligent methods are disclosed in patent disclosures WO 96/10123 and U.S. Pat. No. 5,558,153, incorporated herein by reference.

Referring again to the second embodiment shown in FIGS. 11A–11J, the tool positions are shown immediately after the released isolations sleeve 102 has moved to a closed position. At the end of the isolation sleeve's 102 downward stroke threads located on lower, more distal end of the outside diameter of the piston collar 106 mate with threads formed on the inner radius of the C-ring 134 (see FIG. 11F). Mating the threads on the outer radius of the piston collar 106 with the threads on the inner radius of the C-ring 134 secure the isolation sleeve 102 in the isolating position. In the closed position, lower seals 156 on the seal tubing 124 engage with the seal surface 157 in the isolation string 101 (see FIG. 11I). This isolates the lower end of the production screen 26 while the upper end is isolated by the ring seal 119 (see FIG. 11F). In the isolating position, the isolation sleeve 102 prevents fluid flow from the production zone through the production screen 26.

With the isolation sleeve 102 in the closed position, the service tool 138 is ready for removal from the isolation string 101. In this second embodiment of the invention, the washpipe 112 is long enough for the service tool seal 160 to clear the upper packer 18 (see FIG. 10A) when the release tool 100 engages the pop lock 108 (see FIG. 10E). When the isolation sleeve 102 becomes closed, this clearance prevents a vacuum from developing below the service tool 138. As noted above, if a vacuum develops below the service tool 138, the service tool 138 will be effectively stuck in the isolation string 101.

In FIGS. 12A–12J, the isolation sleeve 102 is again shown in a closed position. Further, the service tool 138 is removed and a removal tool 120 is inserted in the wellbore (see FIG. 12F). Should it become necessary or desirable to raise the isolation sleeve 102 in the future, a piston collet 103 is provided on the inner radius of the top of the piston 126 for mating with a removal tool 120. Of course, if the isolation sleeve 102 is to be removed, the hydraulic dampener 118 must be unlocked from the isolation sleeve 102. This is accomplished by pulling the isolation sleeve 102 upward relative to the isolation string 101 until the lock ring 152 indicates against the ring seal 119. Upon indication, the lock ring 152 will slide relative to the dampening ring 151 to release the dampening ring 151 from the isolation sleeve 102. The isolation sleeve 102 may then be taken from the wellbore.

Figure 16:
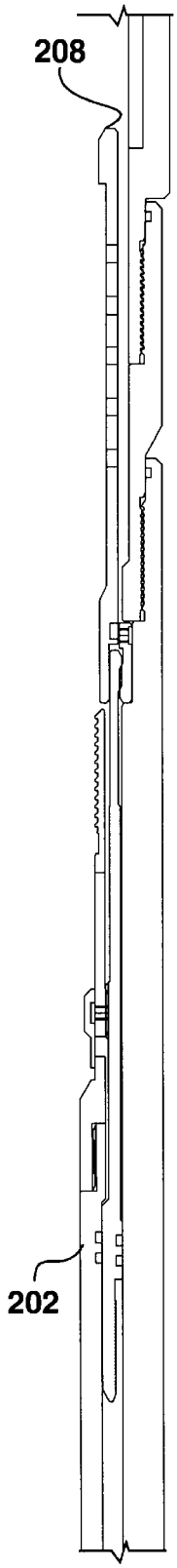
FIG. 16 represents a cross sectional view of an additional alternative isolation system of the present invention.

FIG. 16 depicts a third embodiment of the invention in cross sectional view. While this embodiment uses a hydrostatic chamber to close the isolation sleeve 202 as described above, it does not utilize a release tool 100. Instead, the alternative pop lock 208 has a relatively smaller inner diameter. Similar to the second embodiment, this embodiment is assembled at the surface before the service tool and isolation string is placed in the wellbore. This prior assembly allows the wash pipe (not shown) to extend below the alternative pop lock 208. The wash pipe of this embodiment is equipped with a wash pipe latch 240 (shown in FIG. 14) which catches the alternative pop lock 208 as the wash pipe 112 is pulled up in the wellbore. In all other respects, this embodiment is the same as the second embodiment.

When it is desirable to produce from the isolated zone, a production string is inserted in the wellbore to mate with the isolation string 101. Then the isolation sleeve 102 may be perforated as is know in the art, or sleeve valves placed on the seal tubing 124 may be operated from a closed to open positions. Sleeve valves are described in U.S. Pat. No. 5,865,251, the disclosure of which is incorporated herein by reference.

According to a fourth embodiment of the invention, there is provided a service tool 10 similar to that of the first embodiment (see FIGS. 1A–2B). At the distal end of the service tool 10 there is a locking slick joint 30 similar to that of the first embodiment. However, this fourth embodiment of the invention has a release tool 100 attached to the distal end of the locking slick joint 30. The isolation sleeve 102 comprises a piston 126, a hydraulic dampener 118, and seal tubing 124 as in the second embodiment. Further, the piston 126 is driven by a hydrostatic chamber 104 as described above. Therefore, rather than pushing the isolation sleeve 102 with the locking slick joint 30, the isolation sleeve 102 is activated by lowering the release tool 100 with the locking slick joint 30 to trip a trigger. Of course, the trigger releases the piston 126 which pushes the isolation sleeve 102 to a closed position. An advantage of this embodiment is that there is no need for a wash pipe 112 to extend below the locking slick joint 30. Also, the reliability of the hydrostatic chamber 104 ensures complete closure of the isolation sleeve 102. It is also possible to use various isolation sleeves with this fourth embodiment of the invention, including: the concentric isolation sleeve 21 shown in FIG. 1B and having isolation sliding sleeves 24, and the concentric isolation sleeve 21*a* having a glass disk 39 shown in FIG. 3.

According to a fifth embodiment of the invention, the service tool 138 has a configuration similar to that shown relative to the second embodiment. In this fifth embodiment, the washpipe is removed and the service tool 138 is modified to allow fluid to pass through the service tool 138 immediately subsequent closure of the isolation sleeve 102 by a hydrostatic chamber 104. The modification could be to provide a mechanism to open the fracture valve 161 (see FIG. 7B) when the release tool 100 is positioned adjacent the pop lock 108. Other means for opening a passage within the service tool 138 are also possible as known by persons of skill in the art.

The present invention, therefore, is well adapted to carry out the objects and attain the ends and advantages mentioned, as well as others inherent therein. While a presently preferred embodiment of the invention has been given for purposes of disclosure, numerous changes in the details of procedures for accomplishing the desired results will readily suggest themselves to those skilled in the art, and which are encompassed within the spirit of the invention and the scope of the appended claims.

5 well casing
10 Service tool
15 upper seal bore
16 lower seal bore
17 base seal bore
17*a* Intermediate seal bore
18 upper packer
19 lower packer
20 Isolation string
21 Concentric isolation sleeve
22 Isolation string collar
24 Isolation sliding sleeves
25 Isolation sliding sleeve apertures
26 Production screen
27 Isolation tube apertures
28 Exterior concentric seal assemblies
29 Isolation tube
30 Locking slick joint
31 Locking slick joint outer sleeve
32 Locking slick joint female sleeve
33 Locking slick joint male sleeve
34 Mating ledge
35 Recess
36 open end
37 closed end
38 Locking slick joint tip
39 glass disk
40 Crossover assembly
41 Fracture port assembly
42 Fracture port chamber
43 Fracture ports
44 inner pipe
45 Aperture
46 outer pipe
47 outer holes
48 central lumen
52 Perforations
60 Annular passage
61 Locking slick joint plug
62 tip aperture
63 tip seals
64 upper set recess
65 lower mating ledge
66 lower set recess
84 well bore
100 Release tool
101 Isolation string

102 Isolation sleeve
103 piston collet
104 Hydrostatic chamber
105 Shoulder
106 piston collar
106*a* lower section
106*b* upper portion
107 Fingers
107*a* Head
108 poplock
109 Seals
110 pop lock shear pin
111 pop lock lip
112 wash pipe
114 wash pipe collet
116 Release tool capture collet
118 Hydraulic dampener
119 ring seal
120 Removal tool
124 seal tubing
126 Piston
128 wrap screen
130 seal tubing seals
134 C-ring
136 seal port shoulder
138 Service tool
140 Release tool latch
142 Release tool shear pin
144 Release tool indicator collet
151 Dampening ring
152 lock ring
153 gravel pack sleeve
154 gravel pack collet
155 gravel packer shoulder
156 lower seals
157 seal surface
160 Service tool seal
161 Fracture valve
202 Isolation sleeve
208 Alternative pop lock
240 wash pipe latch

What is claimed is:

1. An isolation system comprising:

an isolation string, wherein said isolation string has a packing assembly which secures said isolation string in a wellbore casing, wherein said isolation string has a production screen which allows production fluid to pass into said isolation string;

an isolation sleeve which slides within said isolation string between open and closed positions;

a locking device which locks said isolation sleeve in an open position; and an activation tool which allows said isolation sleeve to move to a closed position, wherein the open position allows fluid communication between the production screen and an interior portion of said isolation string and the closed position prevents fluid communication between the production screen and the interior portion of said isolation string, wherein said isolation sleeve comprises at least one isolation valve which is coupled within said isolation sleeve, wherein said at least one isolation valve is movable between open and closed positions.

2. An isolation system comprising:

an isolation string, wherein said isolation string has a packing assembly which secures said isolation string in a wellbore casing, wherein said isolation string has a production screen which allows production fluid to pass into said isolation string;

an isolation sleeve which slides within said isolation string between open and closed positions;

a locking device which locks said isolation sleeve in an open position; and an activation tool which allows said isolation sleeve to move to a closed position, wherein the open position allows fluid communication between the production screen and an interior portion of said isolation string and the closed position prevents fluid communication between the production screen and the interior portion of said isolation string, wherein said isolation sleeve has a seal which mates with a sealing surface only at one end of the production screen, wherein said isolation sleeve isolates the production screen from an interior portion of said isolation string.

3. An isolation system comprising:

an isolation string, wherein said isolation string has a packing assembly which secures said isolation string in a wellbore casing, wherein said isolation string has a production screen which allows production fluid to pass into said isolation string;

an isolation sleeve which slides within said isolation string between open and closed positions;

a locking device which locks said isolation sleeve in an open position; and an activation tool which allows said isolation sleeve to move to a closed position, wherein the open position allows fluid communication between the production screen and an interior portion of said isolation string and the closed position prevents fluid communication between the production screen and the interior portion of said isolation string, wherein said locking device comprises at least one shear pin between said isolation sleeve and said isolation string, and a locking slick joint on the activation tool which pushes said isolation sleeve to unlock the isolation sleeve.

4. An isolation system as claimed in claim 3, wherein said locking slick joint comprises:

a female sleeve having at least one mating ledge;

a male sleeve having at least one recess in an outer surface which receives the at least one mating ledge of the female sleeve, wherein said female sleeve is slideable in an axial direction relative to said male sleeve between run-in and extended positions;

an outer sleeve positioned around the female sleeve which secures the female sleeve in both run-in and extended positions.

5. An isolation system as claimed in claim 3, wherein said locking slick joint comprises a channel through an interior of the locking slick joint, wherein said channel allows fluid communication between a space within said isolation string and a space without said isolation string when the locking slick joint is in an extended position.

6. An isolation system comprising:

an isolation string, wherein said isolation string has a packing assembly which secures said isolation string in a wellbore casing, wherein said isolation string has a production screen which allows production fluid to pass into said isolation string;

an isolation sleeve which slides within said isolation string between open and closed positions;

a locking device which locks said isolation sleeve in an open position; and an activation tool which allows said isolation sleeve to move to a closed position, wherein the open position allows fluid communication between the production screen and an interior position of said isolation string and the closed position prevents fluid communication between the production screen and the interior portion of said isolation string, wherein said locking device comprises a trigger that secures the isolation sleeve to the isolation string before the trigger is activated and releases the isolation sleeve to the isolation string after the trigger is activated, wherein said trigger comprises:

a piston collar having a solid cylindrical portion attached to the isolation sleeve and a finger portion having at least one finger, wherein the at least one finger has a head at a distal end; and at least one recess in said isolation string, wherein the head of the at least one finger is engaged in the at least one recess;

a cylindrically shaped pop lock positioned adjacent the head of the at least one finger so that the head is between the pop lock and the recess, wherein the pop lock secures the head relative to the recess; and a latch attached to the service tool which couples with the pop lock, wherein said trigger is activated by removing the pop lock from the position adjacent the head.

7. An isolation system as claimed in claim 6, wherein said latch is attached to a release tool coupled to the service tool.

8. An isolation system as claimed in claim 6, wherein said latch is attached to a wash pipe which extends from a distal end of the service tool.

9. An isolation system comprising:

an isolation string, wherein said isolation string has a packing assembly which secures said isolation string in a wellbore casing, wherein said isolation string has a production screen which allows production fluid to pass into said isolation string;

an isolation sleeve which slides within said isolation string between open and closed positions;

a locking device which locks said isolation sleeve in an open position; and an activation tool which allows said isolation sleeve to move to a closed position, wherein the open position allows fluid communication between the production screen and an interior portion of said isolation string and the closed position prevents fluid communication between the production screen and the interior portion of said isolation string, wherein said activation tool comprises:

a piston driven by a hydrostatic chamber which comprises lower pressure within the hydrostatic chamber than without, and wherein the piston moves said isolation sleeve from the open to the closed position.

10. An isolation system comprising:

an isolation string, wherein said isolation string has a packing assembly which secures said isolation string in a wellbore casing, wherein said isolation string has a production screen which allows production fluid to pass into said isolation string;

an isolation sleeve which slides within said isolation string between open and closed positions;

a locking device which locks said isolation sleeve in an open position; and an activation tool which allows said isolation sleeve to move to a closed position, wherein the open position allows fluid communication between the production screen and an interior portion of said isolation string and the closed position prevents fluid communication between the production screen and the interior portion of said isolation string, wherein said activation tool comprises: a locking slick joint on the service tool which pushes said isolation sleeve to move said isolation sleeve from the open to the closed position, wherein the locking slick joint modifies the effective length of the service string.

11. An isolation system as claimed in claim 10, wherein said locking slick joint comprises:

a female sleeve having at least one mating ledge;

a male sleeve having at least one recess in an outer surface which receives the at least one mating ledge of the female sleeve, wherein said female sleeve is slideable in an axial direction relative to said male sleeve between run-in and extended positions;

an outer sleeve positioned around the female sleeve which secures the female sleeve in both run-in and extended positions.

12. An isolation system comprising:

an isolation string, wherein said isolation string has a packing assembly which secures said isolation string in a wellbore casing, wherein said isolation string has a production screen which allows production fluid to pass into said isolation string;

an isolation sleeve which slides within said isolation string between open and closed positions, wherein the open position allows fluid communication between the production screen and an interior portion of said isolation string and the closed position prevents fluid communication between the production screen and an interior portion of said isolation string, wherein said isolation sleeve comprises at least one isolation valve which is coupled within said isolation sleeve, wherein said at least one isolation valve is movable between open and closed positions;

a locking device which locks and unlocks said isolation sleeve in an open position, wherein said locking device comprises a trigger that secures the isolation sleeve to the isolation string before the trigger is activated and releases the isolation sleeve from the isolation string after the trigger is activated, wherein said trigger comprises:

a piston collar having a solid cylindrical portion attached to the isolation sleeve and a finger portion having at least one finger, wherein the at least one finger has a head at a distal end; and at least one recess in said isolation string, wherein the head of the at least one finger is engaged in the at least one recess;

a cylindrically shaped pop lock positioned adjacent the head of the at least one finger so that the head is between the pop lock and the recess, wherein the pop lock secures the head relative to the recess; and a latch attached to a service tool which couples with the pop lock, wherein said trigger is activated by removing the pop lock from the position adjacent the head; and an activation tool which allows said isolation sleeve to move to a closed position, wherein said activation tool is a piston driven by a hydrostatic chamber which comprises lower pressure within the hydrostatic chamber than without, and wherein the piston moves said isolation sleeve from the open to the closed position.

13. A process for isolating a production zone within a well, said process comprising:

installing an isolation string and a service tool simultaneously within the well adjacent the production zone, wherein the isolation string comprises an isolation sleeve;

locking the isolation sleeve in an open position during said installing an isolation string, wherein the open position allows fluid communication between the production zone and an interior portion of said isolation string;

unlocking the isolation sleeve with the service tool; and moving the isolation sleeve to a closed position, wherein the closed position prevents fluid communication between the production zone and the interior portion of said isolation string, wherein said unlocking the isolation sleeve comprises exerting a force on the isolation sleeve with an extended locking slick joint and shearing a shear pin between the isolation sleeve and the isolation string, and wherein said moving comprises pushing the isolation sleeve with the extended locking slick joint.

14. A process as claimed in claim 13, further comprising modifying the service tool to a position for unlocking the isolation sleeve.

15. A process as claimed in claim 14, wherein said modifying the service tool comprises extending a locking slick joint.

16. A process as claimed in claim 14, wherein said modifying the service tool comprises moving a release tool from a first location on the service tool to a second location on the service tool.

17. A process as claimed in claim 13, further comprising:

opening a channel through said service tool, wherein said channel allows fluid communication between a space within said isolation string and a space without said isolation string; and withdrawing said service tool from said isolation string.

18. A process for isolating a production zone within a well, said process comprising:

installing an isolation string and a service tool simultaneously within the well adjacent the production zone, wherein the isolation string comprises an isolation sleeve;

locking the isolation sleeve in an open position during said installing an isolation string, wherein the open position allows fluid communication between the production zone and an interior portion of said isolation string;

unlocking the isolation sleeve with the service tool; and moving the isolation sleeve to a closed position, wherein the closed position prevents fluid communication between the production zone and the interior portion of said isolation string, wherein said unlocking the isolation sleeve comprises using the service tool to release a trigger which holds the isolation sleeve in the open position, and wherein said moving comprises allowing a hydrostatic chamber to drive a piston connected to the isolation sleeve.

19. An isolation system comprising:

an isolation string, wherein said isolation string has a packing assembly which secures said isolation string in a wellbore casing, wherein said isolation string has a production screen which allows production fluid to pass into said isolation string;

an isolation sleeve which slides within said isolation string between open and closed positions;

a locking device which locks and unlocks said isolation sleeve in an open position; and an activation tool which allows said isolation sleeve to move to a closed position, wherein the open position allows fluid communication between the production screen and an interior portion of said isolation string and the closed position prevents fluid communication between the production screen and an interior portion of said isolation string, wherein said activation tool comprises a channel which allows fluid communication between a space within said isolation string and a space without said isolation string, whereby said activation tool may be pulled from the isolation string when the isolation sleeve is in a closed position without creating vacuum pressure within the isolation string.

* * * * *